United States Patent [19]

Goldsmith

[11] 4,408,366

[45] * Oct. 11, 1983

[54] CLEANING SYSTEM HAVING IMPROVED AGITATION

[76] Inventor: Aaron Goldsmith, 21821 Burbank Blvd., Woodland Hills, Calif. 91367

[ * ] Notice: The portion of the term of this patent subsequent to May 31, 2000 has been disclaimed.

[21] Appl. No.: 173,974

[22] Filed: Jul. 31, 1980

Related U.S. Application Data

[63] Continuation of Ser. No. 162,577, Jun. 24, 1980.

[51] Int. Cl.[3] ..... A47L 11/00

[52] U.S. Cl. ..... 15/321; 15/322; 15/382

[58] Field of Search ..... 15/320, 321, 322, 382

[56] References Cited

U.S. PATENT DOCUMENTS

| | | | |
|---|---|---|---|
| 89,790 | 5/1963 | Balamuth et al. . | |
| 2,333,829 | 11/1943 | Terry . | |
| 3,154,890 | 11/1964 | Lemelson . | |
| 3,200,433 | 8/1965 | Downey . | |
| 3,609,787 | 10/1971 | Areleo et al. . | |
| 3,711,891 | 1/1973 | Conway | 15/321 |
| 3,739,417 | 6/1973 | Sawyer . | |
| 3,803,666 | 4/1974 | Sawyer . | |
| 4,019,218 | 4/1977 | Cyphert . | |
| 4,069,541 | 1/1978 | Williams et al. | 15/321 X |
| 4,095,309 | 6/1978 | Sundheim | 15/321 |
| 4,156,952 | 6/1979 | Lynch . | |
| 4,307,484 | 12/1981 | Williams | 15/322 X |

FOREIGN PATENT DOCUMENTS

| | | | |
|---|---|---|---|
| 2717486 | 10/1978 | Fed. Rep. of Germany | 15/322 |

*Primary Examiner*—Chris K. Moore

[57] ABSTRACT

The present invention provides an improved carpet cleaning system for low cost, high reliability, improved cleaning solution recovery, and reduced carpet wear. In one embodiment, an integral beater bar and solution dispensing arrangement are provided for both dispensing cleaning fluid and agitating the carpet at the same time. Close proximity between the solution dispensing devices and the vacuum recovery ports enhances fluid recovery. Use of a solenoid in conjunction with a beater bar improves carpet cleaning and reduces carpet wear.

25 Claims, 10 Drawing Figures

BACKVIEW
WITH BACK PLATE
REMOVED

CLEANING SYSTEM HAVING IMPROVED AGITATION

CROSS REFERENCE TO RELATED APPLICATIONS

This application is a continuation application of parent application CARPET CLEANING SYSTEM by Aaron Goldsmith Ser. No. 162,577 filed on June 24, 1980 and incorporated herein by reference; where the benefit of the filing date of said parent application is herein claimed in accordance with the U.S. Code such as 35 USC 120 and 35 USC 121 and other authorities provided therefor.

This application is related to other continuations of said parent application (a) CLEANING SYSTEM HAVING IMPROVED CLEANING SOLUTION RECOVERY Ser. No. 174,270 filed on July 31, 1980 by Aaron Goldsmith and (b) IMPROVED CARPET CLEANING SYSTEM Ser. No. 208,939 filed on Nov. 21, 1980 by Aaron Goldsmith.

BACKGROUND OF THE INVENTION

1. Field of the Invention

The field of the invention is fluid or solution dispensing systems and particularly carpet cleaning systems.

2. Prior Art

The prior art includes many carpet cleaning systems which dispense cleaning solution, agitate the carpet, and recover the cleaning solution. These systems prefer rotating brushes for agitating the carpet and spray nozzles for spraying cleaning solution on the carpet. Solution dispensing arrangements are located relatively remote from the vacuum recovery device, causing cleaning solution to penetrate deeply into the carpet prior to recovery and therefore degrading solution recovery effectiveness. Use of brushes causes penetration of the carpet with flexible bristles and consequently pulling out of carpet fibers and general degradation of the carpet and excessive wear. Such systems are relatively expensive and complex, having the further disadvantage of poor reliability. For example, rotating brushes are connected with belts and pulleys which are relatively expensive and a common source of maintenance problems.

Standard methods of cleaning rugs provide for motor driven rotary brushes which require much service because of the use of motors, belts, brushes, and other requirements such as cooling air and electrical isolation. Additionally, the rotating brushes scrape material and remove or damage the carpet during the cleaning process.

Other cleaning methods and apparatus for cleaning textile fabric surfaces have heretofore been proposed. One example of such a method and apparatus may be found in Williams et al. U.S. Pat. No. 4,069,541 issued Jan. 24, 1978. Although this and prior patents achieved some success in the cleaning process, it is still desirable and necessary to improve the effectiveness of such cleaning. The present methods for introducing the water detergent or hydrocarbon cleaning fluids do not provide for high ratios of recovery. Twenty-five percent or more, a large portion of the fluid, is left in the surface being cleaned. The present invention has shown capabilities of recovery from 90% to 96% leaving only 10% to 4%, respectively, in the surface being cleaned.

SUMMARY OF THE INVENTION

An invention is provided for cleaning various surfaces, such as rugs, upholstery, carpeting, etc; wherein a heated cleaning solution is distributed over an area of the surface to be cleaned and then agitated by a vibrating solenoid. This solenoid operates a combined fluid distributor and beater bar which vibrates at a rate of between 30 and 180 Hertz while the cleaning fluid is being injected into the surface material. A vacuum head then withdraws the cleaning fluid from the surface. The action is enhanced by a flexible air-seal located between the distributor bar and the vacuum head and by means of which the dirt-laden liquid is almost totally withdrawn.

The present invention relates to the cleaning, dying, painting, etc of materials and surfaces such as rugs, upholstery, clothing, furs, artificial turf, masonry, concrete, walls, etc. A modified version of this invention could also be used for painting flat surfaces.

In a preferred embodiment a carpet cleaner is provided for dispensing cleaning solution, for agitating the carpet with a beater bar, and for recovering contaminated solution with a vacuum recovery system.

The cleaning head of the present invention provides for carpet cleaning, shaking, beating, scrubbing, agitation, etc of the cleaning solution and vacuum dirt removal, all in one simple and lightweight unit. It cleans by injecting a hot carpet cleaning solution into the carpet pile. The solution is agitated, spun, beat and worked deep down into the fibers of the carpet. Dirt and debris are lifted from in the carpet and brought to the surface, where it is held in suspension in the cleaning solution. The solution is then vacuum extracted from the carpet, leaving the carpet clean and dry.

One embodiment of the cleaning head of the present invention uses vibration to power an agitator. This produces powerful high intensity sonic impulses that pulse the cleaning solution and the carpet, causing displacement of dirt particles. Particles are driven into the solution and then vacuumed into a recovery tank.

One embodiment of the present invention consists of a system and process, which is called the HYDROSONIC TM. The HYDROSONIC TM is attached to the wand of a standard carpet cleaner as presently available on the market, such as the HR TM Portable "Steam" Cleaning System, Carpet Magic TM Cleaning System, and other similar systems which provide a source of water containing detergent and a vacuum suction system capable of providing vacuum suction and water separation. This embodiment consists of a cleaning head which is attached to an oscillating solenoid. The vibrating head, operating at frequencies of 30 to 180 Hertz, functions as both a distributor for the cleaning fluid and a beater or agitator for agitation of solution into the material being cleaned to increase the cleaning action and better remove dirt. The configuration of the solution distributor and its location provide for a high efficiency of recovery of the cleaning fluid.

The cleaning head includes a flapper seal, and a flexible diaphram between the suction head and the beater bar and enclosed the space above the fluid; thereby creating a vacuum at the passage and resulting in enhanced recovery of cleaning solution.

An illustrative embodiment of the present invention uses a vibrating head for a liquid dispensing rug cleaner using vacuum for the improved cleaning of rugs, carpets and similar heavy nap materials. It generally comprises a housing coupled to a wand or handle of commercially available cleaning machines. The housing incorporates a liquid dispensing system, a liquid scavenging vacuum, and an electric vibrating beater bar for agitating the surface to be cleaned.

The beater bar can vibrate vertically with respect to the surface being cleaned and can incorporate distribution of cleaning solution with a number of orifices through which the cleaning solution is dispensed under pressure. At the bottom of the housing, there is an opening through which a vacuum recovers air and soiled cleaning fluid, returning it to the cleaning machine.

This system includes an arrangement for distributing cleaning solution, agitating the solution so that dirt particles are forced into suspension, and soluble materials are dissolved; and removing the soiled solution by vacuum.

The present invention provides an improved fluid dispensing arrangement. In a preferred embodiment, an integral beater bar and cleaning solution dispenser provides enhanced capabilities such as enhanced fluid recovery, lower cost, and lower carpet wear. An integral beater bar and solution dispenser arrangement permits locating the solution dispenser close to the vacuum recovery device to facilitate more efficient solution recovery. In addition, the integral beater bar and solution dispenser arrangement enhances cleaning. The beater bar beats the rug, which accelerates the cleaning solution against the rug and accelerates the rug against the cleaning solution. This causes improved cleaning capability and lower carpet wear.

Implementation of an integral fluid dispenser and agitator and, in particular, the use of a plurality of solution orifices distributed along a beater bar such as equally spaced orifices about a quarter of an inch apart facilitates control of cleaning solution placement and cleaning effectiveness.

A solenoid is used to actuate the beater bar to agitate the carpet and cleaning solution. The cleaning solution dispensing device connects cleaning solution under pressure to a beater bar having a cleaning solution conducting tube and dispensing orifices therein. A vacuum recovery system recovers the solution after it has accumulated the carpet contaminants.

An objective of the present invention is to provide an improved carpet cleaner.

Another objective of the present invention is to provide an improved upholstery cleaner.

Another objective of the present invention is to provide an improved painting system.

Another objective of the present invention is to provide an improved fluid dispensing system.

Another objective of the present invention is to provide an improved fluid recovery system.

Another objective of the present invention is to provide a system causing lower carpet wear.

Another objective of the present invention is to provide a simpler, lower cost and more reliable fluid dispensing arrangement.

Another objective of the present invention is to provide an improved system and method of cleaning rugs, upholstery, clothes and other surfaces.

Another objective of the present invention is to provide an improved system and mechanism for cleaning carpets, upholstery and the like by first distributing the cleaning solution on the surface to be cleaned, then agitating the surface rug with the reciprocating power of a vibrator, followed by the recovery of the cleaning solution with greater efficiency than prior art systems and methods.

Another objective to the present invention is to provide a cleaning apparatus which distributes the cleaning solution with improved effectiveness and efficiency.

The foregoing and other objects, features, and advantages of the present invention will become apparent from the following detailed descriptions of preferred embodiments of this invention, as illustrated in the accompanying drawings.

BRIEF DESCRIPTION OF THE DRAWINGS

A better understanding of the present invention may be obtained from a consideration of the detailed description hereinafter taken in conjunction with the drawings which are briefly described below.

FIG. 3 comprising FIGS. 3A and FIG. 3B represent detailed sectioned views and FIG. 3C and FIG. 3D represent simplified diagrams of the sectioned views of FIG. 3A and FIG. 3B respectively.

FIG. 4 comprising

FIG. 5 comprising

Figure 1:
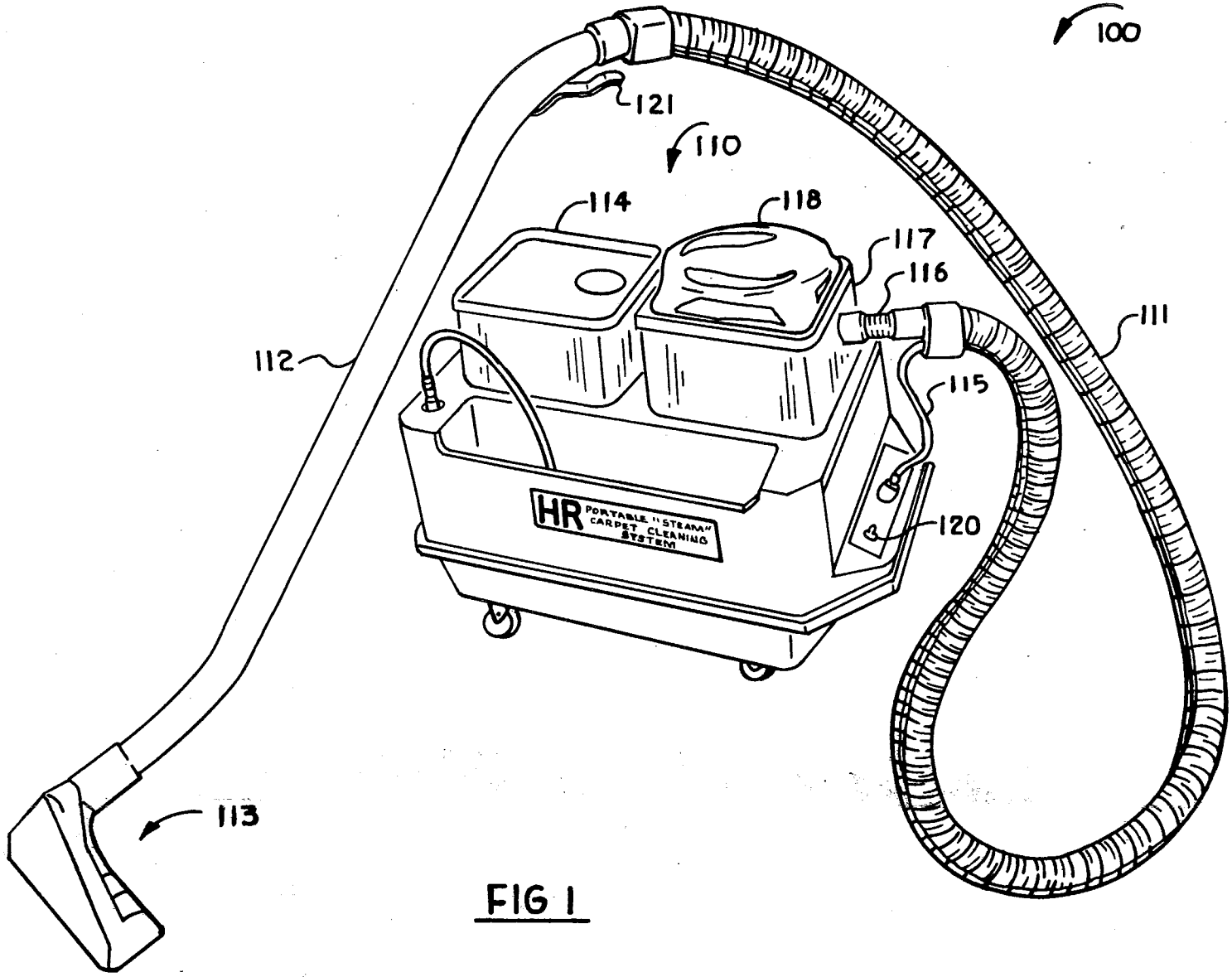
FIG. 1 is a perspective view of a representative carpet cleaning system.

By way of introduction of the illustrated embodiments, the components shown in the figures have been assigned general reference numerals and a description of each such component is given in the following detailed description. The components in the figures have been assigned three-digit reference numerals wherein the hundreds digit of the reference numeral is related to the figure number except that the same component appearing in successive figures has maintained the first reference numeral. For example, the components in FIG. 1 have one-hundred series reference numerals (100 to 199) and the components in FIG. 2 have two-hundred series reference numerals (200 to 299).

DETAILED DESCRIPTION OF THE INVENTION

The system of the present invention can take any of a number of possible forms. Illustrative embodiments of several arrangements of the present invention are shown in the accompanying figures and are described hereinafter.

One embodiment of a system for using the present invention is shown in FIG. 1. This embodiment is discussed relative to a carpet cleaning system for simplicity of discussion and is illustrative of the broader features and uses of the present invention. The invention herein is primarily directed to the cleaning head; an embodiment of which has been adapted for use with a commercially available system. Carpet cleaning system 100 includes console 110, composite hose 111, wand 112, and cleaning head 113. Console 110 provides for dispensing and collecting of cleaning solution. Composite hose 111 and wand 112 provides for flow of cleaning solution in both directions. Head 113 provides for cleaning of a carpet. Console 110, composite hose 111, and wand 112 can be commercially available devices supplied by Household Research Institute and called the 'HR Portable "Steam" Carpet Cleaning System'; the instructions for which are provided herewith as FIG. 2.

Console 110 includes a cleaning solution supply pump (not shown) for supplying cleaning solution and a vacuum pump (not shown) for providing a vacuum to recover cleaning solution. The cleaning solution supply pump can be a commercially available pump such as model No. 002001 pump from Sierra Electric Motors of Reno, Nev. and the vacuum pump can be a commercially available pump such as stock No. 2M173 from W. W. Granger company of Los Angeles, Calif.; which are used in the HR system discussed herein and shown in FIG. 2. Console 110 can be a well known device. Cleaning solution is contained in solution tank 114 and is pumped along solution line 115 through composite hose 111 and wand 112 to cleaning head 113 to be applied to a carpet being cleaned. Solution release valve 121 is connected to solution line 115 as it passes through wand 112. An operator controls flow of cleaning solution by depressing valve 121. Vacuum is applied with a vacuum pump through vacuum hose 116, through composite hose 111 and wand 112 to cleaning head 113 to recover cleaning solution from a carpet being cleaned. Recovered solution is returned to the recovery tank 117 under vacuum dome 118 through vacuum hose 116. A copy of an instruction sheet for operating a commercially available embodiment of such a system is shown in FIG. 2.

Figure 2:
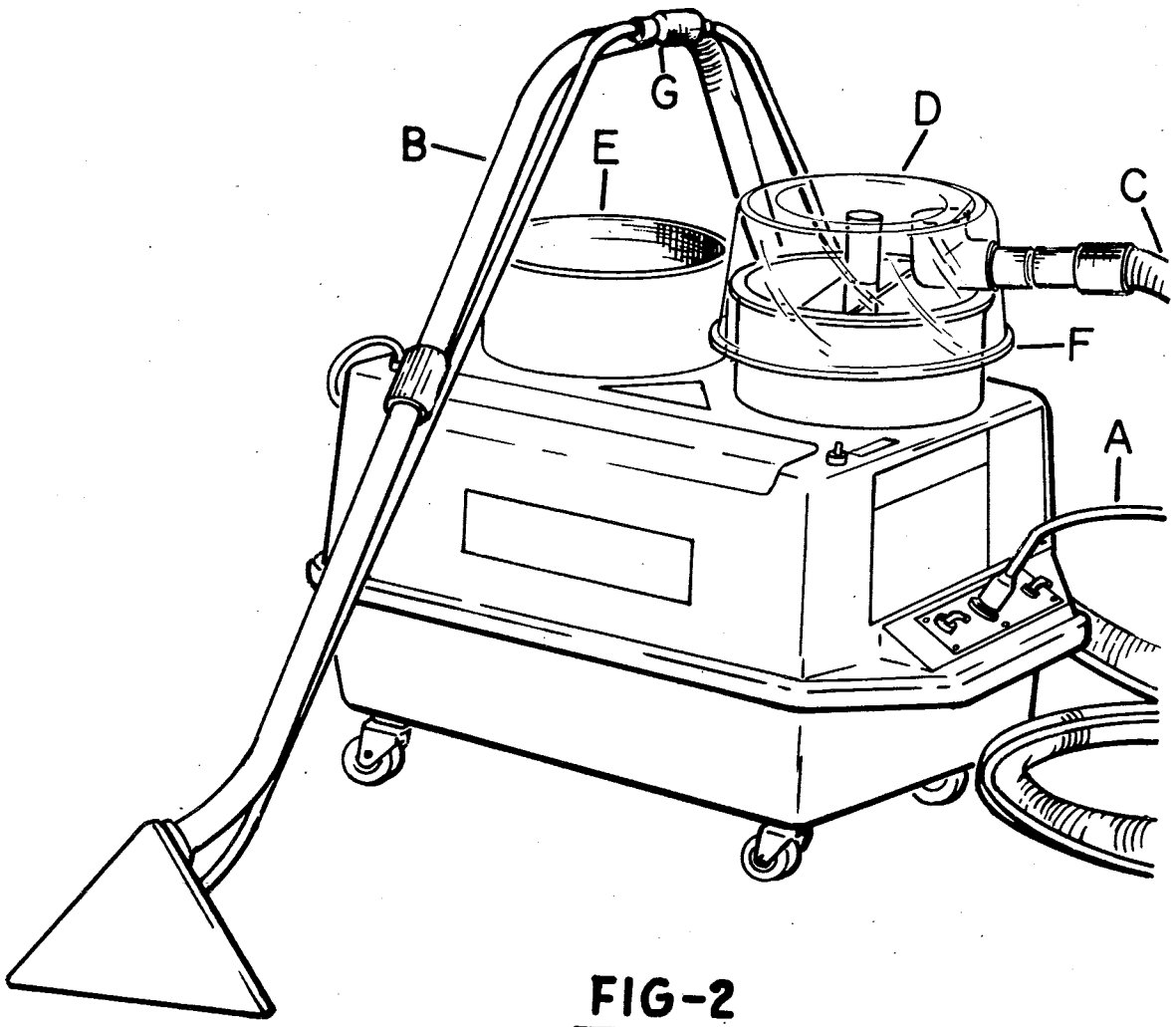
FIG. 2 is a copy of an instruction sheet for a conventional HR carpet cleaning system.

Various cleaning heads 113 (FIG. 1) are available for use with the HR system (FIG. 2). One of these heads contains a cleaning solution nozzle for spraying cleaning solution on a carpet in front of the cleaning head and a vacuum port in the cleaning head for vacuuming cleaning solution from the carpet. This head has no electrical connections and has no electrically operated agitator.

The present invention is primarily directed to an improved head to replace conventional cleaning head 113. In one embodiment, system 100 has been modified to accept the cleaning head of the present invention by adding electrical power wires conducted through composite hose 111 and wand 112 to the cleaning head and by replacing the commercially available cleaning head 113 with the cleaning head of the present invention. Electrical power is controlled with the ON/OFF switch 120 on system 100 and is applied to the cleaning head of the present invention when electrical power is applied to the pumps in console 110 with ON/OFF switch 120.

The present invention is primarily directed to an improved cleaning head 300. In an illustrative embodiment shown in FIG. 3; head 300 is shown in a side view 301 in FIG. 3A, in a front view 302 in FIG. 3B, in a simplified side view 303 in FIG. 3C, and in a simplified front view 304 in FIG. 3D. Wand 112 connects to the head 300 for structural support and for electrical, solution supply, and solution recovery connections. Electrical power is supplied with electrical cord 310 conducted through strain relief grommet 311, and with switch 312 to energize forcer (such as solenoid) 313. Cleaning solution is supplied through inlet fitting 314 for conduction through rigid solution tube 315 and flexible solution tube 316 to agitator (such as beater bar) 317 to be dispensed into a carpet through orifices 318 as shown by arrow 319. Vacuum connection is made through wand 112 and vacuum tube 320 to provide vacuum to vacuum port 321 to return cleaning solution 321A to tank 117 of console 110.

Figure 3A:
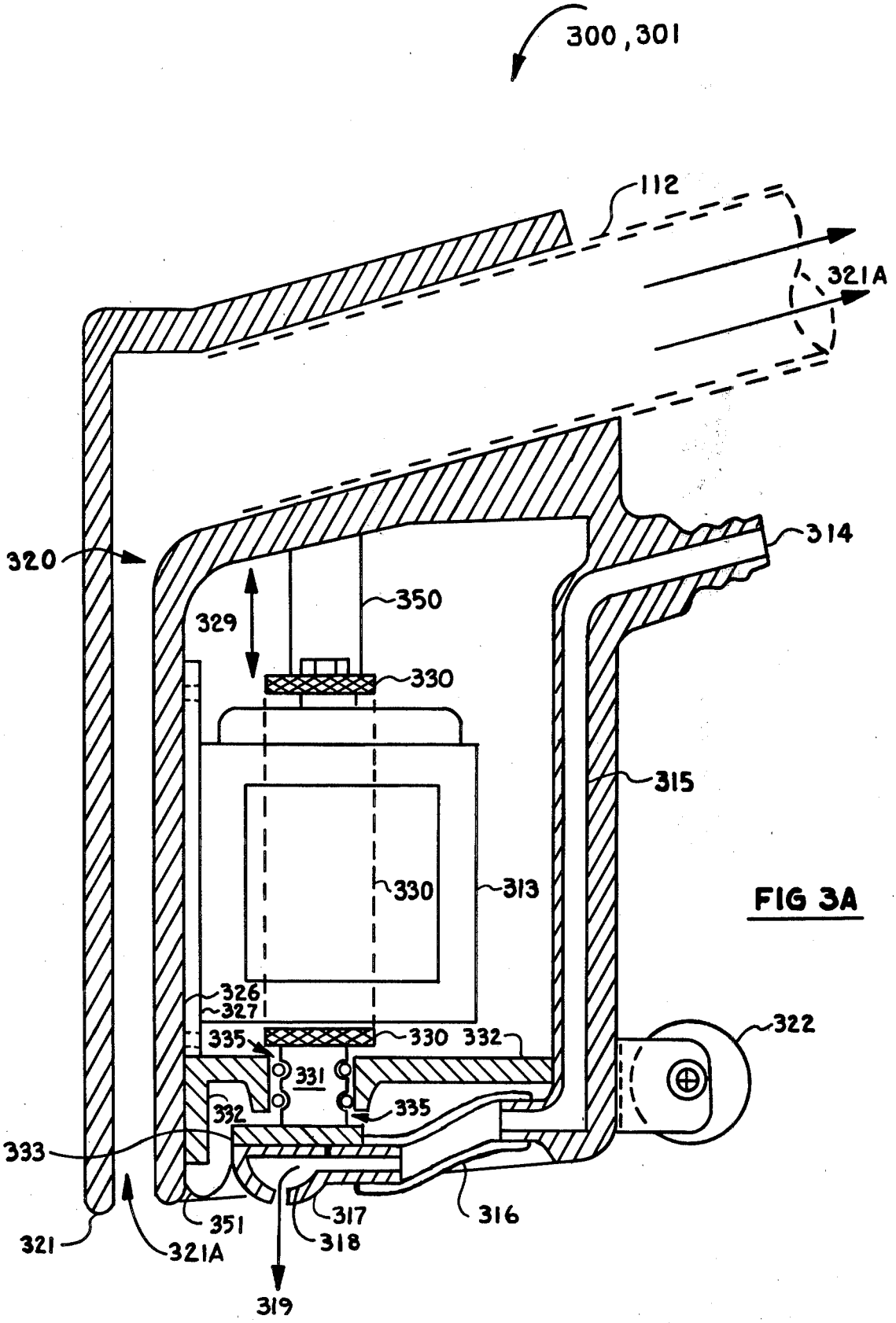
FIGS. 3A to 3D represents sectioned views of one embodiment of a cleaning head in accordance with the present invention; where
Figure 3B:
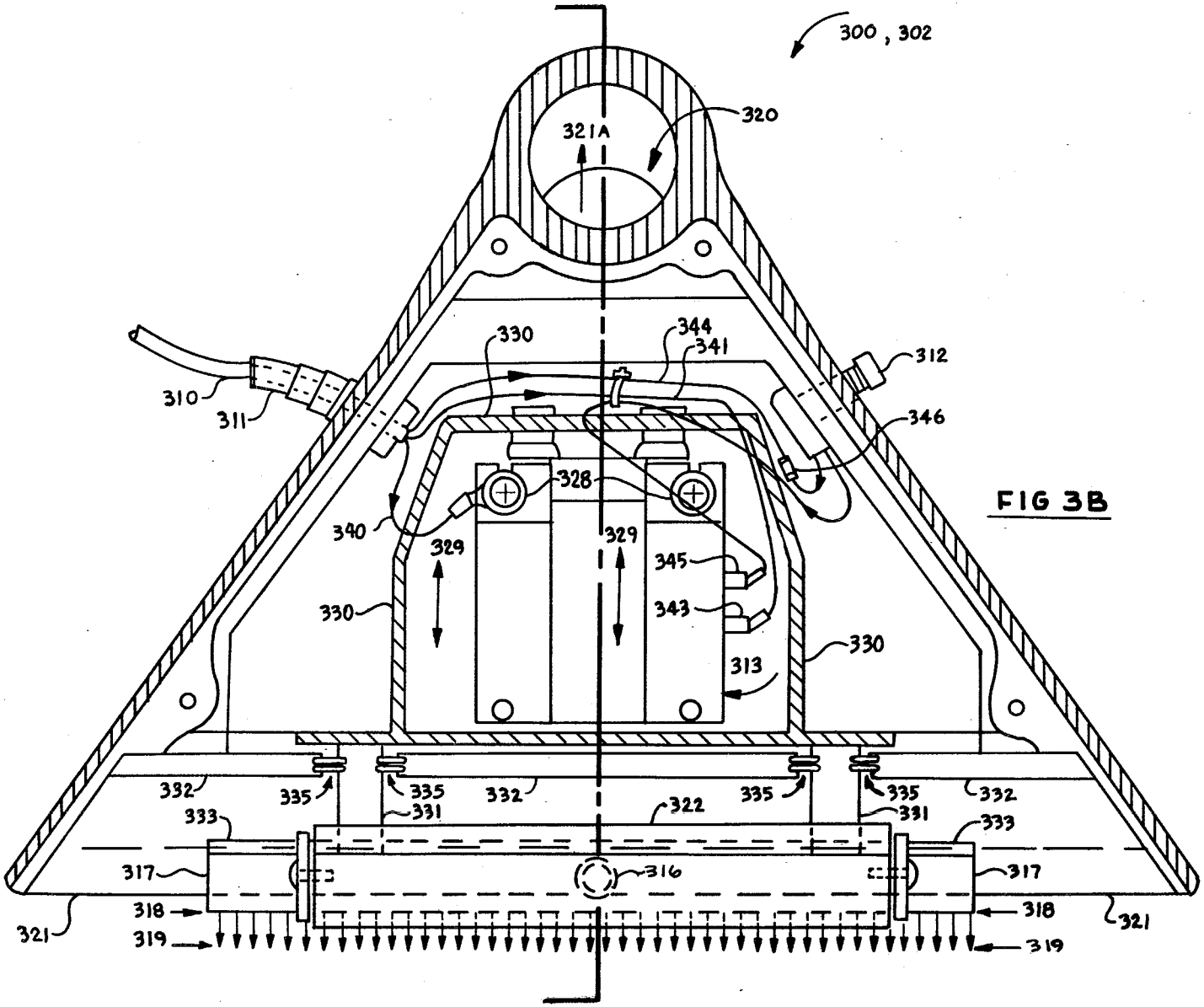
Figure 3C:
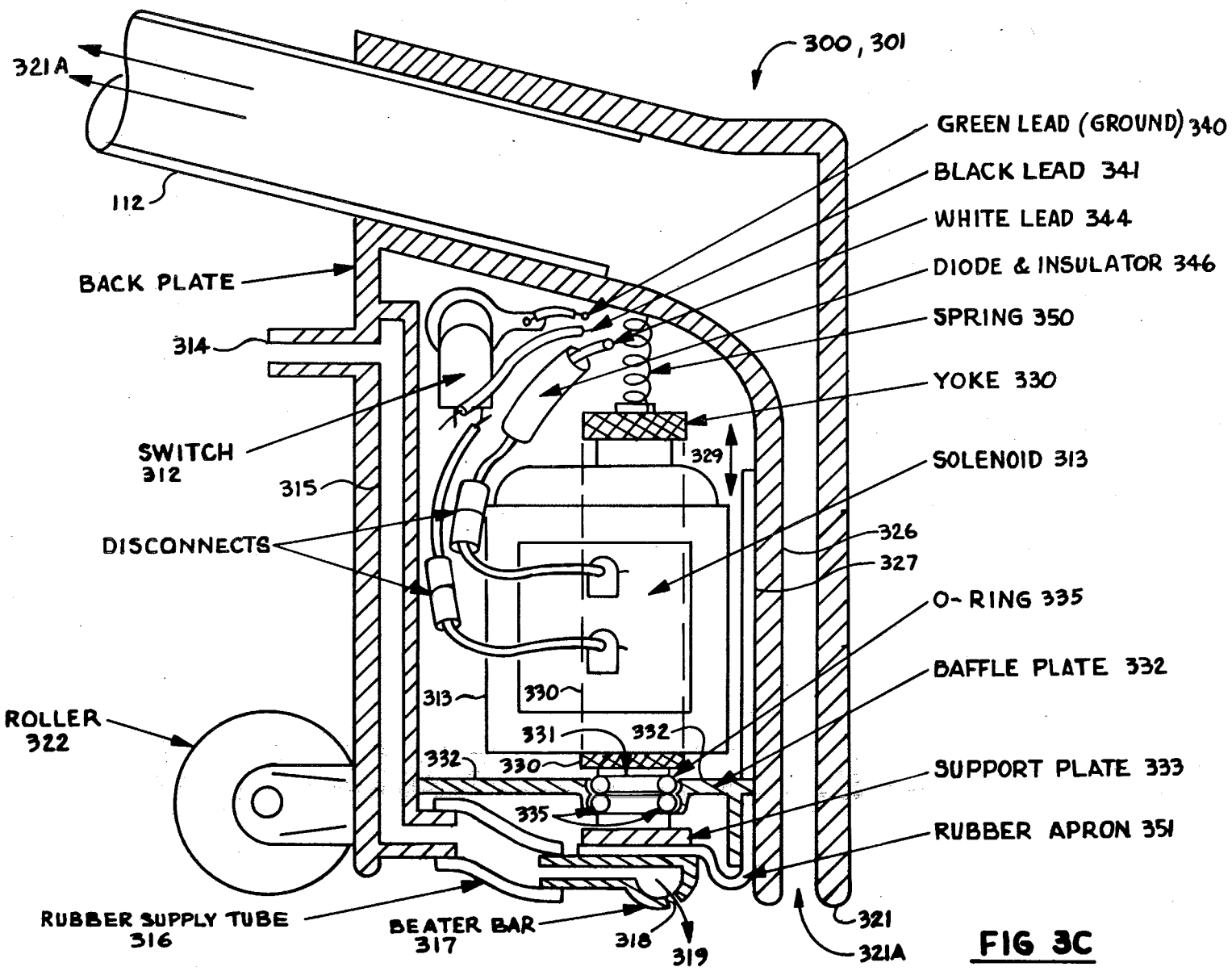
Figure 3D:
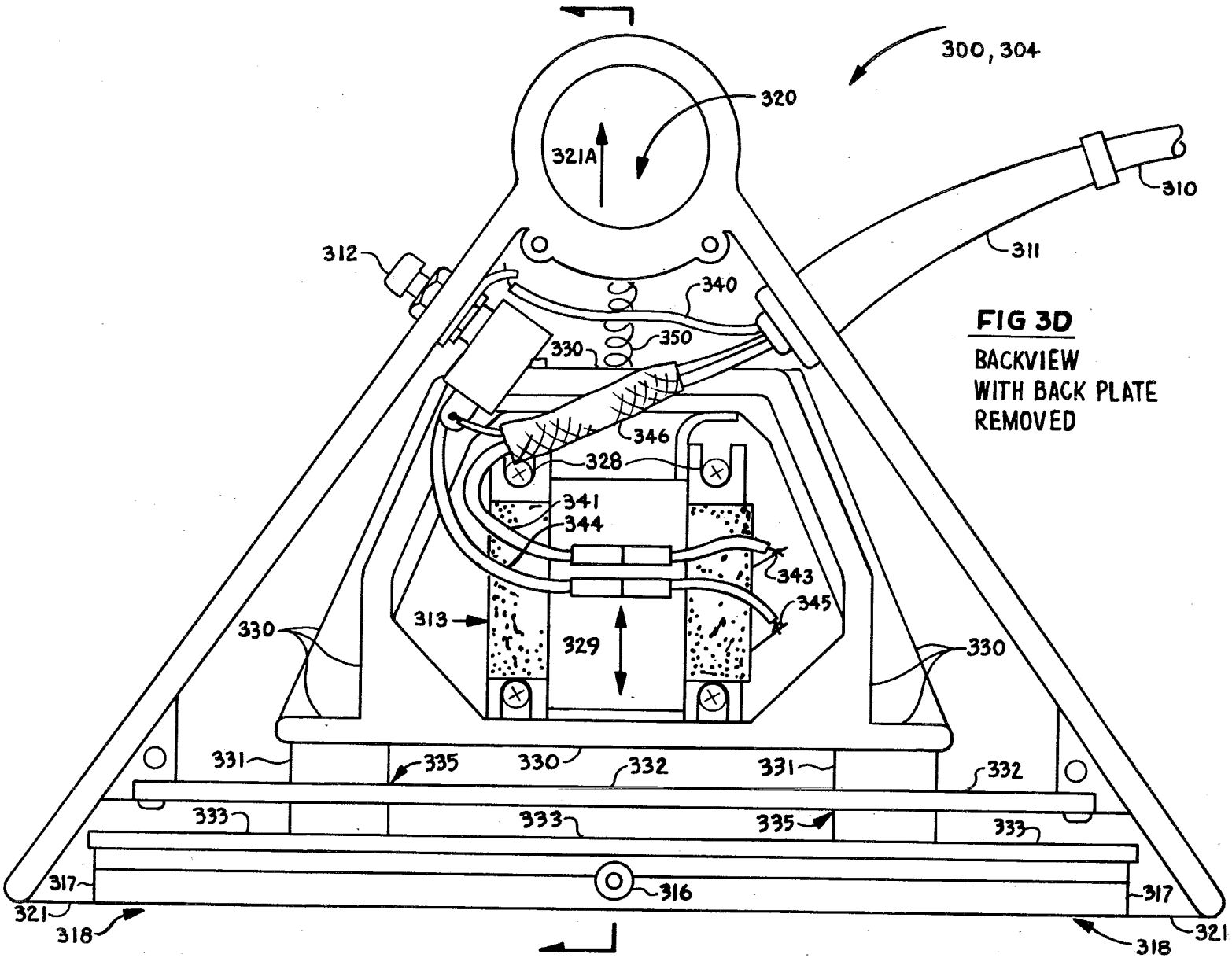

FIG. 3A shows cleaning head 300 sectioned along the length of the solution and vacuum tubes. For example, the length of the rigid solution tube 315, flexible solution tube 316, beater bar tube 317, and orifice 318 are shown in FIG. 3A. Also, the length of the vacuum tubes including wand 112 and vacuum tube 320 and vacuum port 321 are shown in FIG. 3A. FIG. 3B shows cleaning head 300 sectioned through the cross-section of the solution and vacuum tubes. Flexible solution tube 316 is shown connecting to the center portion of beater bar 317 for distribution of solution through orifices 318 at the lower edge of beater bar 317 to supply streams of solution 319 into a carpet. Similarly, vacuum tube 320 is shown connecting to the center portion of cleaning head 300 to provide a vacuum for recovery of cleaning solution from carpet along vacuum port edge 321 for vacuum return.

In one implemented embodiment orifices 318 are 0.040 inches in diameter and have one fourth inch spacing between orifices for 35 orifices across about nine inches of beater bar dispensing length. In one embodiment, orifices 318 may point directly downward. In other embodiments, orifices 318 may point in the forward direction or in the rearward direction to enhance solution recovery and other considerations. Also, orifices 318 closest to the edge of beater bar 317 can be oriented to dispense fluid outward toward the sides of beater bar 317. Various other alternatives and combinations of these techniques may be used by those skilled in the art.

Carpet cleaning is achieved by placing cleaning solution output orifices 318 and cleaning solution recovery port 321 in contact with a carpet and drawing cleaning head 300 forward so that the beater bar 317 leads to dispense cleaning solution to the carpet and the vacuum recovery port 321 follows for recovery of the dispensed cleaning solution. Cleaning is performed with a forward and backward motion, where beater bar 317 and recovery vacuum port 321, are placed in contact with the carpet to supply and recover cleaning solution, respectively. Solution release valve 121 is opened to permit fluid to flow through orifices 318, shown with arrows 319, while cleaning head 300 is drawn towards the operator with wand 112. Therefore, beater bar 317 first traverses a portion of a carpet, followed by vacuum recovery port 321 traversing the same portion of the carpet. After the forward stroke is completed, the operator releases solution release valve 121 to cut off the supply of solution to the carpet. The operator can then tilt head 300 onto roller 322 to roll head 300 away to return it to an extended outward position for another return cleaning stroke. In this way, cleaning solution is first supplied to a carpet and is then recovered from the carpet during the cleaning (forward) stroke and the cleaning solution is cut off during the extension (return) stroke as the operator cleans the carpet.

Enhanced cleaning capability is achieved by actuating an agitator such as beater bar 317 with solenoid 313. Solenoid 313 is mounted to structure 326 with mounting plate 327 (FIG. 3A) using mounting screws 328 (FIG. 3B). Solenoid 313 provides agitation along axis 329 under control of switch 312. Solenoid motion 329 is coupled from solenoid 313 to yoke 330; where yoke 330 is thereby agitated in direction 329. Yoke 330 can surround solenoid 313, as shown in FIG. 3B and as indicated with sectioned and dashed lines in FIG. 3A.

Spring 350 (FIG. 3A and 3C) can be used to provide stabilization for solenoid 313. This spring has been found to provide a stabilizing effect such as for reducing vibrations during initial startup. Pistons 331 are part of yoke 330 and are actuated through structural member or baffle plate 332 to agitate mounting plate 333 and beater bar 317. Pistons 331 are connected to mounting plate 333 and mounting plate 333 is connected to beater bar 317 to agitate the carpet and cleaning solution. Consequently, the actuating member of solenoid 313, yoke 330 including pistons 331, mounting plate 333 and beater bar 317 are agitated as a single assembly in direction 329. Therefore, beater bar 317 is actuated against a carpet to beat or agitate the carpet as the cleaning solution is being supplied to the carpet, thereby enhancing cleaning effectiveness.

Pistons 331 are supported with O-rings 335 maintained in position with circular indentures in pistons 331 and baffle plate 332. Use of O-rings provides advantages such as providing structural support, providing bearing devices, providing compliance for agitation motion, and providing sealing against contamination of the internal parts of cleaning head 300 with cleaning solution. A rubber apron 351 may be used for a baffle, guard, support, and other purposes. This rubber apron may be a sheet of rubber bonded to the adjacent surfaces as shown in FIGS. 3 and 4.

Solenoid 313 may be any agitating device but, in an implemented embodiment, solenoid 313 was implemented with solenoid part number 4X895 manufactured by Dormeyer Industries; 3418 North Milwaukee Avenue; Chicago, Ill. 60641. Excitation is supplied to solenoid 313 with electrical cord 310 having three electrical wires. A first electrical wire is ground wire 340 connected to solenoid mounting screw 328. A second wire is a first AC electrical power wire 341 connected to a first terminal 343 of solenoid 313. A third wire is a second AC electrical power wire 344 connected to a second terminal 345 of solenoid 313 through switch 312 and diode 346. Switch 312 provides for opening and closing the electrical circuit, through the first AC electrical power wire 341 and the second AC electrical power wire 344 to solenoid 313. Switch 312 may be a well-known switch but, in an implemented embodiment, is a single-pole double-throw (SPDT) toggle switch for toggling power ON and OFF conditions. Diode 346 may be a known diode having sufficient power handling capability to supply solenoid 313. Diode 346 can be a commercially available diode such diode part No. A14P manufactured by General Electric Company and having a 3 ampere and 1,000 volt rating consistent with the requirements to energize the above-referenced solenoid used in an implemented embodiment. Diode 346 provides for rectifying the AC electrical power provided on wires 341 and 344 to generate rectified excitation to solenoid 313. Rectified AC electrical power to solenoid 313 provides 120 Hz half-sine wave signals to cause solenoid 313 to be actuated at a high rate for actuating beater bar 317 at the high rate to agitate a carpet and cleaning fluid.

A rubber seal apron 351, located between the beater bar 317 and vacuum pickup opening 321, provides a seal between the vacuum opening 321 and the beater bar 317, resulting in greatly increased vacuum suction in the area immediately below and in front of the beater bar while the pile of a carpet is being vibrated and washed.

To prevent fluid from being splashed up into the interior of the cleaning head assembly, a baffle plate 332 and O-ring seals 335 are utilized.

Figure 4A:
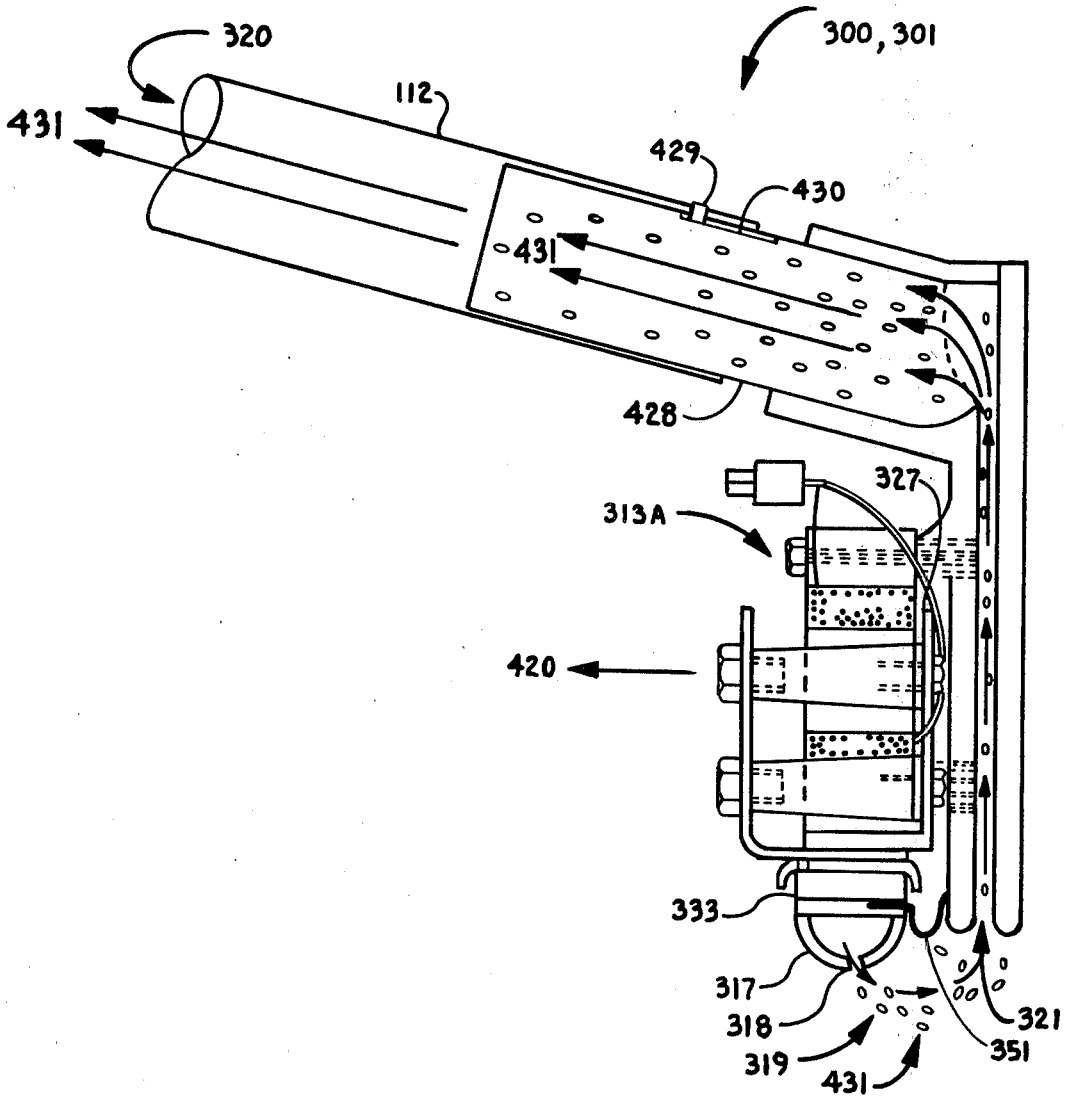
FIGS. 4A and 4B represents sectioned views of an alternate embodiment of a carpet cleaning head in accordance with the present invention.
Figure 4B:
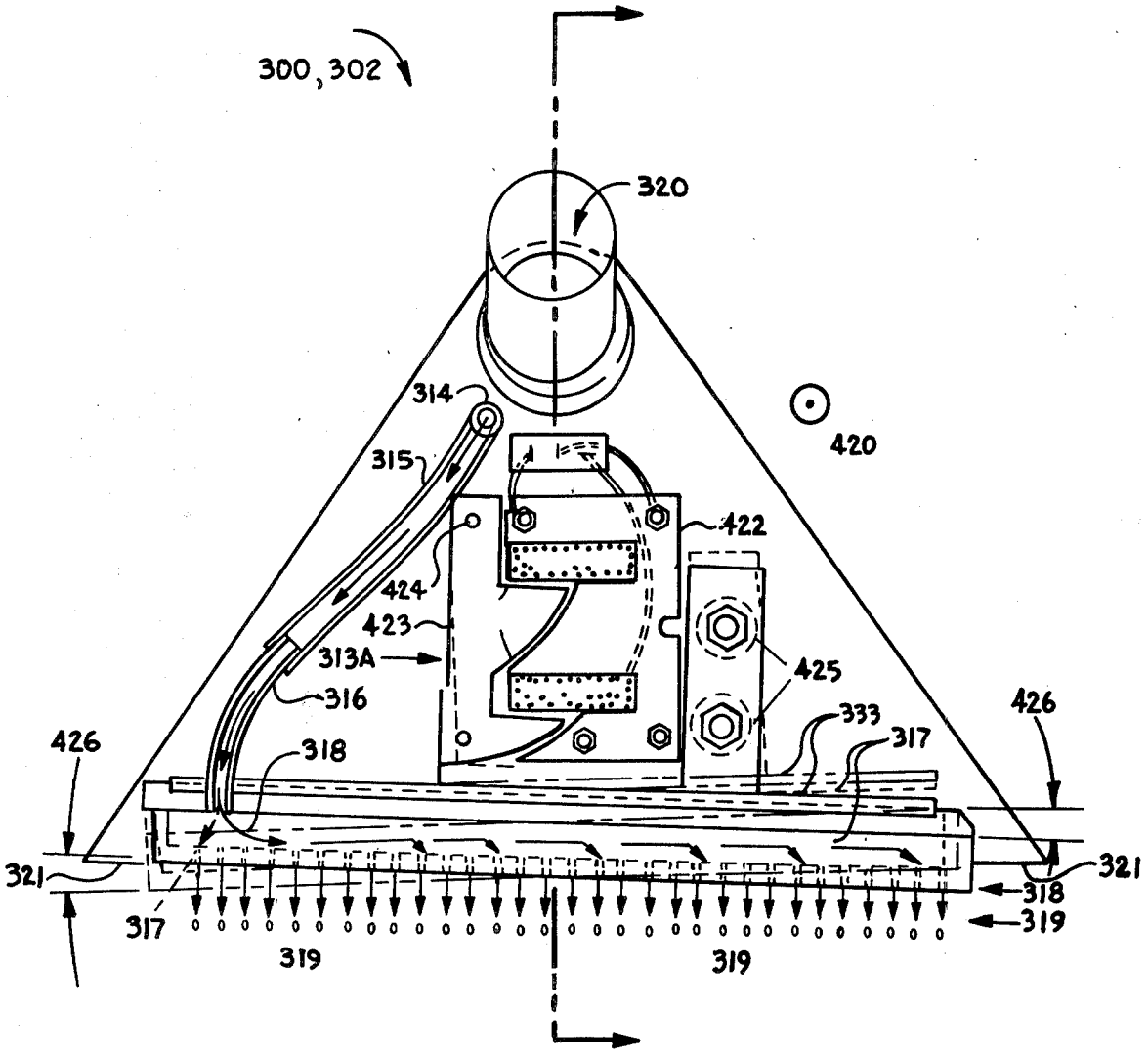

An alternate embodiment of the cleaning head of the present invention is shown in FIG. 4; where FIGS. 4A and 4B of this alternate embodiment correspond to FIGS. 3A and 3B, respectively, of the embodiment discussed above. Corresponding elements in FIGS. 3 and 4 have corresponding reference numbers. Therefore, the description provided for the elements of FIG. 3 above is equally applicable to corresponding elements of FIG. 4, with the exceptions discussed below. Beater bar 317 (FIG. 4) is mounted to rotate around axis 420 under control of solenoid 313A. This provides rotary motion of beater bar 317 indicated by angle 421. In this configuration, beater bar 317 provides agitating motion caused by beater bar rotation 421, where the arrangement discussed relative to FIG. 3 provides agitation caused by beater bar translation 329. Solenoid 313A (FIG. 4) is a rotary solenoid, in contrast to translational solenoid 313 (FIG. 3). Such rotary solenoids are well-known in the art such as used for electric sanders and other tools. Element 422 is the stationary portion of solenoid 313A and element 423 is the rotational portion of solenoid 313A rotating about hinge point 424. A brief auxiliary discussion of the arrangement of FIG. 4 will now be presented.

FIG. 4B shows a plastic tube 316 delivering cleaning solution to beater bar 317. Solution is then distributed through orifices 318 to the item to be cleaned. The beating motion is generated by a solenoid 313 which rotates about pin 424. The extent of the beating motion is indicated by the arrows 426. Two rubber mounting posts 425 function as springs to control the oscillations and damp vibrations of the solenoid 331, thereby helping to reduce noise.

FIG. 4A is a side view of the cleaning head. After the vibrating beater bar 317 distributes and agitates cleaning solution into the surface being cleaned, the solution is recovered by suction through vacuum inlet 321 in the cleaning head which is positioned parallel to the beater bar 317. The rubber air-seal diaphragm 351 is attached parallel and adjacent to both the beater bar 317 and the vacuum inlet 321. The air-seal 351 maintains a vacuum near vacuum inlet 321 which increases the cleaning solution recovery efficiency. The cleaning solution containing dirt is carried from the vacuum inlet 321, through the wand 112 and composite hose 111 to a recovery tank 117 in the console 110. The cleaning head 300 can be connected to the wand 112 by a metal sleeve 428 with a spring loaded release pin 429 which fits into a locking hole 430 on wand 112. Cleaning fluid flows through the apparatus in the directions indicated by arrows 431.

Figure 5A:
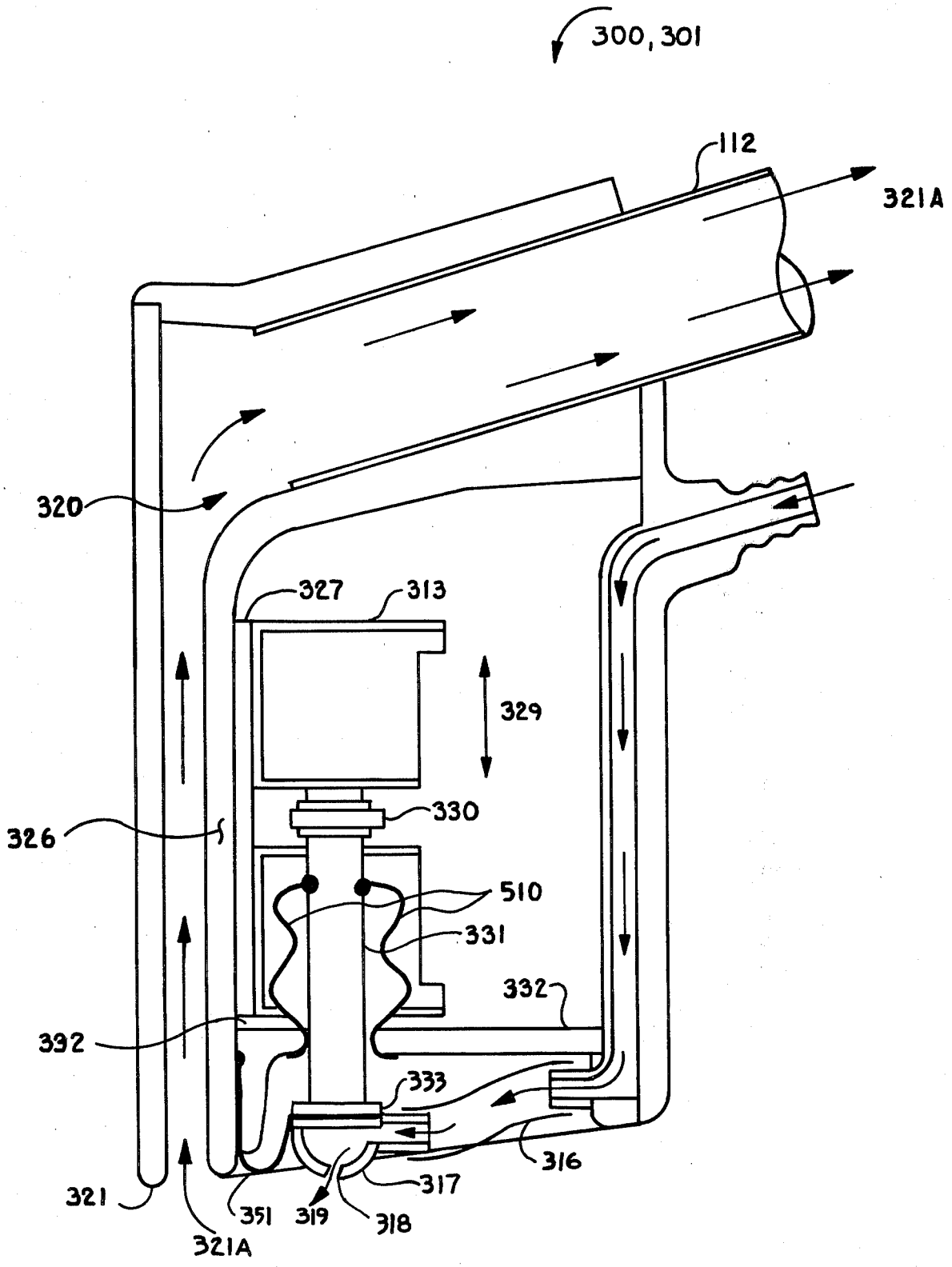
FIGS. 5A and 5B represents sectioned views of a further alternate embodiment of a carpet cleaning head in accordance with the present invention.
Figure 5B:
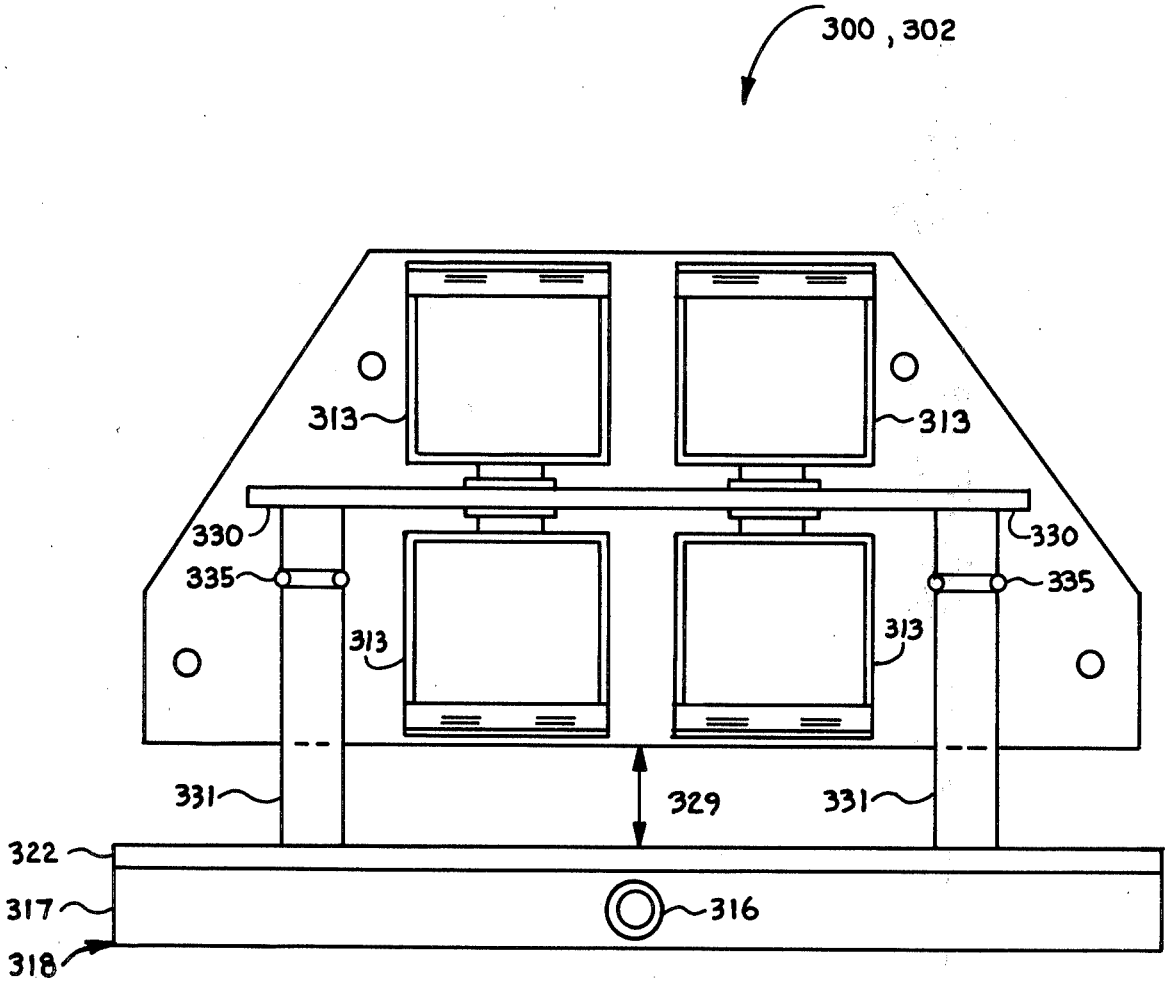

A further alternate embodiment of the cleaning head of the present invention is shown in FIG. 5; where FIGS. 5A and 5B of this alternate embodiment correspond to FIGS. 3A and 3B respectively and FIGS. 4A and 4B respectively of the embodiments discussed above. Corresponding elements in FIGS. 3 and 5 have corresponding reference numerals. Therefore, the descriptions provided for the elements of FIG. 3 above are equally applicable to corresponding elements of FIG. 5 with the exceptions discussed below. FIG. 5B is primarily related to the agitating portion of the cleaning head. Differences include use of multiple solenoids used in a push-pull arrangement in place of the single solenoid of the arrangement shown in FIG. 3. Differences also include use of a bellows 510 in place of O-rings 335 of the arrangement shown in FIG. 3.

For simplicity of illustration, the system of the present invention has been discussed in the configuration of a carpet cleaning system or rug shampooing system. Many other uses of this invention can be made, as discussed below. In one alternate embodiment, the present invention may be used for upholstery cleaning or shampooing in addition to or in place of carpet cleaning or shampooing. In another alternate embodiment, the present invention may be used for cleaning of walls or other surfaces. In yet another alternate embodiment, the present invention may be used for painting, where a paint solution, varnish solution, or other coating solution may be substituted for the cleaning solution discussed with reference to FIG. 1 through FIG. 5 herein.

A detailed description of certain illustrative embodiments has been provided with reference to FIG. 1 through FIG. 5 for simplicity of illustration. Many other embodiments can be implemented with variations discussed below.

Embodiments using a solenoid for translational and rotational vibration have been discussed. Alternate embodiments can utilize motors and other motive devices to provide agitation. For example, an AC motor driving a beater bar through an eccentric will convert rotational motion of the motor to translational motion of the beater bar to provide agitation.

Various structural devices have been discussed in the illustrative embodiments of FIG. 1 through FIG. 5 herein including a case, a yoke, a metal mounting plate, mounting hardware, etc. These structural devices may be changed in form, shape, and use in various ways that can be implemented by the skilled in the art from the teachings herein.

In the illustrative embodiment of FIG. 3, orifices for supplying cleaning solution 318 have been shown directed downward. In alternative embodiments, orifices 318 can be directed at a downward angle such as toward vauum port 321 for improved recovery of cleaning solution. Also, orifices 318 have been shown as being integral with beater bar 317. Alternately, a separate cleaning solution dispensing arrangement may be provided such as nozzles for spraying solution. In such an embodiment, solution may be dispensed inbetween the beater bar 317 and the vacuum port 321, or beater bar 317 may be located inbetween solution dispensing orifices 318 and vacuum port 321, or other arrangements may be provided.

The teachings of the present invention provide many advantages over prior art arrangements. These advantages will now be discussed.

An actual implementation of the present invention has been tested and has been shown to achieve extremely high recovery of cleaning solution. Conventional systems are relatively inefficient in recovery of cleaning solution, where unrecovered cleaning solution remains in the carpet. Various features of the present invention have permitted recovery of over 95% of the cleaning solution dispensed. The system of the present invention provides for recovery of better than 90% of the cleaning solution in one embodiment and for better than 95% of the cleaning solution in another embodiment compared to about 75% to 80% of the cleaning solution recovery in prior art systems. This improvement in cleaning solution recovery is implicit in the arrangement shown in FIG. 3. An important contributing feature that enhances cleaning fluid recovery is the dispensing of cleaning solution within the structural outline of the cleaning head 300. Prior art systems often dispense cleaning solution outside of the cleaning head area at a long distance from the vacuum recovery port. Another feature that enhances cleaning solution recovery is close proximity between the solution dispenser (orifice 318) and vacuum port 321. Because of this close proximity (FIG. 3), the fluid penetration into the carpet after dispensing is reduced because of the short distance between dispenser and recovery devices. Other systems have large distances between solution dispensers and solution recovery ports, which permits the solution to penetrate deeply into the carpet, thereby limiting the degree of recovery. Another feature that enhances cleaning solution recovery is the use of a plurality of solution dispensing orifices 318 in place of the conventional solution dispensing nozzle using a solution spray.

Another feature that enhances cleaning solution recovery, cost, and other considerations is an integral solution dispenser and beater bar, where beater bar 317 contains part of the solution tube and solution dispensing orifices 318. Use of an integral solution dispenser and beater bar enhances solution recovery by permitting the solution dispensing orifices 318 to be located relatively close to the vacuum recovery port 321. Systems using brushes located between the solution dispensing nozzle and the vacuum recovery port causes wide separation between the solution dispensing nozzle and the vacumm recovery port, which permits the solution to penetrate deeper into the carpet prior to recovery. This conventional arrangement causes less efficient solution recovery. Use of an integral solution dispenser and beater bar facilitates close proximity between solution dispensing orifices 318 and the vacuum recovery port 321 for enhanced solution recovery, such as reducing penetration of the solution into the carpet.

Conventional carpet cleaners using brush arrangements to penetrate the carpet with flexible bristles and tear strands from the carpet, and otherwise cause excessive carpet wear. Use of a beater bar facilitates reduced carpet wear. For example, in a preferred embodiment, beater bar 317 is a smooth rigid member that does not penetrate the carpet, thereby agitating the carpet without tearing or excessively wearing the carpet.

Fluid is herein intended to mean cleaning solution, paint, water, and other fluids.

Further characterizations of the present invention are as follows.

An apparatus for cleaning textile materials which consists of a fluid distribution head attached to a vibrating solenoid for purposes of both distributing and agitating liquid into the textile surface, a vacuum intake parallel to the distribution head to remove the fluid from the textile surface, and a sealing strip between the vacuum intake and fluid distribution head which maintains the vacuum between the apparatus and the surface and thus increases water recovery efficiency. This arrangement can include an arrangement where the fluid distribution head is attached to solenoid and consists of an elongated cavity with multiple holes in a line along its length which serve the purpose of applying the cleaning solution to the surface, beating the surface, and agitating the solution into the surface to facilitate improved cleaning of the surface.

An apparatus for cleaning textile materials consisting of a fluid distribution head which is an elongated cavity with multiple holes in a line along its length for applying cleaning fluid to a surface, a vibrating motor to which said distribution head is mounted in order to facilitate distribution and agitation of cleaning fluid into surface, a vacuum intake parallel to the distribution head to remove the fluid from the surface, and a sealing strip between the vacuum intake and distribution head to maintain the vacuum between the apparatus and the surface.

An apparatus for dyeing or painting surfaces which consists of a paint distribution head attached to a vibrating solenoid for purposes of distributing paint on a surface, a vacuum intake parallel to the distribution head to remove excess paint, and a sealing strip between the paint distribution head and the vacuum intake to maintain the vacuum between the apparatus and the surface being painted.

From the above description it will be apparent that there is thus provided a device of the character described possessing the particular features of advantage before enumerated as desireable, but which obviously is susceptible to modification in its form, method, mechanization, operation, detailed construction and arrangement of parts without departing from the principles involved or sacrificing any of its advantages.

While in order to comply with the statute, the invention has been described in language more or less specific as to structural features, it is to be understood that the invention is not limited to the specific features shown, but that the means, method, and construction herein disclosed comprise the preferred form of several modes of putting the invention into effect and the invention, is, therefore, claimed in any of its forms or modifications within the legitimate and valid scope of the appended claims.

What I claim is:

1. A cleaning system comprising:

means for supplying cleaning fluid;

means for agitating the cleaning fluid supplied by said cleaning fluid supplying means;

means for dispensing agitated cleaning fluid at least partially in response to the agitation of cleaning fluid from said agitating means;

means for recovering cleaning fluid dispensed by said dispensing means;

said agitating means and said dispensing means being an integral structure and being mounted and movable independent of the rest of said cleaning system; and means for mounting said recovery means adjacent to said integral structure.

2. The system as set forth in claim 1 above, wherein said cleaning fluid supplying means includes a tank for storing cleaning fluid and a pump for supplying cleaning fluid stored in said tank to said agitating means, wherein said agitating means includes a cleaning fluid device for conveying cleaning fluid from said supplying means to said dispensing means and motive means for agitating said cleaning fluid conveyor to provide the agitating of the cleaning fluid; and wherein said dispensing means includes a plurality of orifices for dispensing the agitated cleaning fluid.

3. The system as set forth in claim 1 above, wherein said dispensing means is integral with said agitating means to provide the agitating of the cleaning fluid during the dispensing of the cleaning fluid.

4. The system as set forth in claim 1 above, wherein said recovering means includes means for generating a vacuum and means for recovering cleaning fluid dispensed by said dispensing means with said vacuum.

5. The system as set forth in claim 1 above, further comprising means for mounting said recovering means next to said dispensing means.

6. A cleaning system comprising:

means for supplying cleaning fluid;

means for agitating the cleaning fluid from said cleaning fluid supplying means, including motive means for generating motion and beater means for providing agitation;

means for dispensing agitated cleaning fluid at least partially in response to agitation of the cleaning fluid from said agitating means, including means for conveying cleaning fluid in contact with said beater means; and means for dispensing agitated cleaning fluid in contact with said beater means.

7. The system as set forth in claim 1 above, wherein said dispensing means includes a plurality of orifices for dispensing a plurality of streams of agitated cleaning fluid.

8. The system as set forth in claim 1 above, wherein said agitating means further includes means for agitating a surface to be cleaned together with the agitating of the cleaning fluid to provide agitation of the cleaning fluid against the agitated surface to be cleaned.

9. The system as set forth in claim 1 above, wherein said dispensing means includes means for dispensing the agitated cleaning fluid to provide acceleration between the agitated cleaning fluid and a surface being cleaned.

10. A carpet cleaning system comprising:

means for supplying cleaning fluid;

means for agitating the cleaning fluid from said cleaning fluid supplying means, including beater means for agitating the cleaning fluid in combination with agitating the carpet being cleaned; and means for dispensing agitated cleaning fluid at least partially in response to agitation of the cleaning fluid from said agitating means, including means for dispensing the agitated cleaning fluid from said beater means to provide acceleration between the agitated cleaning fluid being dispensed and the carpet being cleaned.

11. The system as set forth in claim 1 above, further comprising vacuum recovery means for recovering cleaning fluid dispensed by said dispensing means with a vacuum and a diaphragm for providing a vacuum seal between said dispensing means and said recovery means.

12. The system as set forth in claim 7 above, further comprising a housing at least partially surrounding said agitating means said agitating means including a piston, and an O-ring surrounding at least a portion of said piston for mounting said agitating means relative to said housing.

13. A carpet cleaning system comprising integral means for cleaning a surface, said integral means including an integral agitating means incorporating beater means for providing agitation and an integral fluid dispensing means for dispensing cleaning fluid, said beater means for agitating the cleaning fluid dispensed by said integral fluid dispensing means in combination with agitating the carpet being cleaned, and said integral fluid dispensing means including means for dispensing the agitated cleaning fluid from said beater means to provide acceleration between the agitated cleaning fluid being dispensed and the carpet being cleaned.

14. A cleaning system comprising integral means including an integral agitating means for providing agitation and an integral fluid dispensing means for dispensing cleaning fluid, a vacuum recovery means for recovering cleaning fluid dispensed by said integral fluid dispensing means with a vacuum, and a diaphragm for providing a vacuum seal between said integral fluid dispensing means and said recovery means.

15. A carpet cleaning system comprising an integral agitating means for providing agitation and an integral fluid dispensing means for dispensing cleaning fluid, at least a portion of said agitating means and said dispensing means being movable independent of the rest of said carpet cleaning system, said integral agitating means including a piston, and an O-ring surrounding at least a portion of said piston so as to resiliently support the integral agitating means relative to the rest of said carpet cleaning system.

16. A carpet cleaning system comprising:
means for supplying cleaning fluid;
means for supplying a vacuum;
a cleaning head for cleaning a carpet, said cleaning head including
(a) motive means for providing motive force;
(b) cleaning means for cleaning a carpet in response to the motive force from said motive means and in response to the cleaning fluid being supplied from said cleaning fluid supplying means, wherein said cleaning means includes
(1) means for agitating a carpet to be cleaned in response to the motive force from said motive means, said agitation means including a piston,
(2) means for agitating cleaning fluid in response to the motive force from said motive means, and
(3) means for dispensing the agitated cleaning fluid into an agitated carpet to be cleaned,
(c) recovering means for recovering cleaning fluid dispensed by said dispensing means in response to vacuum supplied by said vacuum supplying means;
(d) means for providing a vacuum seal between said dispensing means and said recovery means; and
(e) support means for said carpet agitating means, including an O-ring resiliently and compliantly disposed about said piston for mounting said carpet agitating means.

17. A carpet cleaning system comprising:
means for supplying cleaning fluid;
means for supplying a vacuum;
a cleaning head for cleaning a carpet, said cleaning head including
(a) motive means for providing motive force;
(b) cleaning means for cleaning a carpet in response to the motive force from said motive means and in response to the cleaning fluid being supplied from said cleaning fluid supplying means, wherein said cleaning means includes
(1) means for agitating a carpet to be cleaned in response to the motive force from said motive means, said agitating means including a piston,
(2) means for agitating cleaning fluid in response to the motive force from said motive means, and
(3) means for dispensing the agitated cleaning fluid into an agitated carpet to be cleaned,
(c) recovering means for recovering cleaning fluid dispensed by said dispensing means in response to vacuum supplied by said vacuum supplying means;
(d) support means for said motive means, said cleaning means and said recovering means, and
(e) an O-ring resiliently and compliantly disposed within said support means about said piston for supporting said agitating and said dispensing means.

18. The carpet cleaning system as set forth in claim 17 wherein said agitating means includes means for accelerating fluid dispensed with said fluid dispensing means against a carpet to be cleaned; said system further comprising means for supplying cleaning fluid to said integral fluid dispensing means.

19. The carpet cleaning system as set forth in claim 17, wherein said cleaning fluid supplying means includes a tank for storing cleaning fluid and a pump for supplying cleaning fluid stored in said tank to said agitating means, wherein said agitating means includes a cleaning fluid conveyor for conveying cleaning fluid from said cleaning fluid supplying means to said fluid dispensing means, said motive means providing agitation for said cleaning fluid conveyor to provide the agitating of the cleaning fluid, and wherein said fluid dispensing means includes a plurality of orifices for dispensing the agitated cleaning fluid.

20. The carpet cleaning system as set forth in claim 17, further comprising means for mounting said recovering means next to said integral fluid dispensing means.

21. The carpet cleaning system as set forth in claim 17, further comprising mounting means for mounting said fluid supplying means next to said recovering means.

22. The carpet cleaning system as set forth in claim 17, wherein said cleaning fluid supplying means includes a tank for storing cleaning fluid and a pump for supplying cleaning fluid stored in said tank to said cleaning means, wherein said cleaning fluid agitating means includes a cleaning fluid device for conveying cleaning fluid from said supplying means to said dispensing means, and wherein said dispensing means includes a plurality of orifices for dispensing the agitating cleaning fluid.

23. The carpet cleaning system as set forth in claim 17, wherein said dispensing means is integral with said cleaning fluid agitating means to provide the agitating of the cleaning fluid during the dispensing of the cleaning fluid.

24. The carpet cleaning system as set forth in claim 17, wherein said dispensing means and said cleaning fluid agitating means are an integral structure, said supporting means mounting said recovery means adjacent to said integral structure.

25. The carpet cleaning system as set forth in claim 17, wherein said dispensing means includes means for dispensing the agitated cleaning fluid to provide acceleration between the agitated cleaning fluid and the carpet being cleaned.

* * * * *